US008021187B2

(12) United States Patent
Tagawa et al.

(10) Patent No.: US 8,021,187 B2
(45) Date of Patent: Sep. 20, 2011

(54) ELECTRIC CONNECTOR

(75) Inventors: Tetsuya Tagawa, Tokyo (JP); Hiroharu Ikari, Tokyo (JP)

(73) Assignee: I-Pex Co., Ltd., Machida-shi (JP)

( * ) Notice: Subject to any disclaimer, the term of this patent is extended or adjusted under 35 U.S.C. 154(b) by 0 days.

(21) Appl. No.: 12/671,817

(22) PCT Filed: Nov. 10, 2008

(86) PCT No.: PCT/JP2008/070435

§ 371 (c)(1),
(2), (4) Date: Jul. 26, 2010

(87) PCT Pub. No.: WO2010/032342

PCT Pub. Date: Mar. 25, 2010

(65) Prior Publication Data

US 2011/0034076 A1 Feb. 10, 2011

(30) Foreign Application Priority Data

Sep. 19, 2008 (JP) ..... 2008-240322

(51) Int. Cl.
*H01R 13/648* (2006.01)

(52) U.S. Cl. ..... 439/607.31

(58) Field of Classification Search ..... 439/607.31, 439/495

See application file for complete search history.

(56) References Cited

U.S. PATENT DOCUMENTS

| | | | | |
|---|---|---|---|---|
| 6,811,439 | B1 * | 11/2004 | Shin-Ting | 439/607.31 |
| 6,821,149 | B2 * | 11/2004 | Lai | 439/607.31 |
| 7,134,907 | B2 * | 11/2006 | Watanabe et al. | 439/495 |
| 2003/0176111 | A1 * | 9/2003 | Iida et al. | 439/660 |
| 2009/0029601 | A1 * | 1/2009 | Yamaji | 439/694 |

FOREIGN PATENT DOCUMENTS

| | | |
|---|---|---|
| JP | 05 205831 | 8/1993 |
| JP | 2002 015818 | 1/2002 |
| JP | 2006 100105 | 4/2006 |
| JP | 2006 216332 | 8/2006 |
| JP | 2007 193949 | 8/2007 |
| JP | 2008 140555 | 6/2008 |

* cited by examiner

*Primary Examiner* — Briggitte R Hammond
(74) *Attorney, Agent, or Firm* — Oblon, Spivak, McClelland, Maier & Neustadt, L.L.P.

(57) ABSTRACT

An electric connector makes it possible to achieve downsizing excellently to improve electric connection reliability by preventing deformation when fitting to a mating connector. An engaging projection projecting is provided on an opening end edge of either an insulating housing or a conductive shell. An engaging hole into which the engaging projection is inserted is provided on the other opening end edge. The insulating housing and the conductive shell are fixed to each other in a direction orthogonal to the fitting direction by inserting the engaging projection into the engaging hole so that rigidity is largely increased. The fixation mechanism of the insulating housing and the conductive shell do not project inside the insulating housing so that it is possible to reduce the height and make pitches narrow.

6 Claims, 6 Drawing Sheets

ELECTRIC CONNECTOR

TECHNICAL FIELD

The present invention relates to an electric connector configured to be fitted to a mating connector, thereby performing electrical connection of a signal transmission medium such as a coaxial cable.

BACKGROUND ART

In general, in various electric equipments, an electric connector is widely used for the purpose of connection of a terminal of a signal transmission medium comprising a coaxial cable or the like to a printed wiring board, or the like. The electric connector comprises, for example, a first connector connected with a signal transmission medium and a second connector mounted on a printed wiring board, and it is configured such that a signal transmission medium such as a coaxial cable is first connected to a rear end of the first connector and a projection for fitting provided on a front end of the first connector is then inserted into an opening for fitting of the second connector so that fitting of both the connectors is performed.

In such fitting of both the connectors, however, such a case occurs that workers perform assembling work by grasping a signal transmission medium comprising a coaxial cable or the like. When a fitting action utilizing such a signal transmission medium, the so-called flapping fitting action is performed, a front end of the first connector which has been inserted into the second connector moves in a vertical direction so that a conductive contact or an insulating housing of the second connector displaces vertically, which may result in blocking of electrical connectivity of the conductive contact. An opening for fitting of the insulating housing is expanded in a thickness direction at an approximately central portion, particularly in a longitudinal direction, of the opening due to such a flapping action, so that the insulating housing or a conductive shell which is originally formed in a thin flat shape is deformed in a shape expanded in an arched manner, which may result in opposition to thinning of the insulating housing or the conductive shell.

Further, in the case that the conductive contact disposed in the insulating housing has a configuration of being mounted in a cantilever manner, when the front end projection of the first connector is inserted into the second connector, as described above, the conductive contact of the second connector is displaced by the front end projection of the first connector to be pressed on one side wall face of the insulating housing. As a result, the conductive contact or the insulating housing of the second connector deforms vertically in the same manner as the above-mentioned case, so that there is a possibility that electrical connectivity of the conductive contact is blocked or thinning cannot be achieved due to expansion of a size in a thickness direction by an amount corresponding to deformation of the insulating housing.

Such a problem significantly appears as expansion and deformation of the insulating housing, especially when the rigidity of the insulating housing has lowered due to thinning of the whole electric connector or when a length of the signal transmission medium has become large in a multipolar arrangement direction thereof, which results in an important problem to be solved for thinning/height-reducing of the electric connector.

On the other hand, the conductive shell covering the insulating housing is attached to the insulating housing by press fitting or fitting. In conventional electric connectors disclosed in cited references described below, since a fixing mechanism of the conductive shell to the insulating housing is provided to project inside the insulating housing, the thickness of the insulating housing must be expanded by an amount corresponding to provision of the fixing mechanism or a wiring pitch of signal lines in the insulating housing must be expanded.

Patent Literature 1: JPA-2007-193949
Patent Literature 2: JPA-2002-15818
Patent Literature 3: JPA-05-205831

DISCLOSURE OF INVENTION

In view of these circumstances, it is an object of the present invention to provide an electric connector which prevents deformation at a fitting time with a mating connector to improve electric connection reliability with a simple configuration, and can achieve thinning or size reduction excellently.

To achieve the abovementioned object, the present invention provides an electric connector which is configured such that a mating connector is appropriately inserted in a fitting direction through an opening for fitting formed in an insulating housing of the electric connector, where an opening end edge of a conductive shell covering the insulating housing is disposed to extend along an outer surface of an opening end edge forming the opening for fitting of the insulating housing, and the electric connector adopts a configuration where an engaging projection projecting along a fitting direction with the mating connector is provided on either one of the opening end edges of the insulating housing and the conductive shell and an engaging hole through which the engaging projection is inserted in the fitting direction is provided on the other of the opening end edges of the insulating housing and the conductive shell, where the engaging projection is inserted into the engaging hole so that the insulating housing and the conductive shell are fixed to each other in a direction orthogonal to the fitting direction with the mating connector.

According to the electric connector having such a configuration, the insulating housing and the conductive shell are fixed to each other in the direction orthogonal to the fitting direction of both the connectors by such simple work as simply inserting the engaging projection provided on either one of the insulating housing and the conductive shell into the engagement hole provided on the other thereof, so that deformations of the insulating housing and the conductive shell are excellently prevented at a fitting time with the mating connector because the rigidity of the electric connector in the same direction is largely improved. Further, since a fixing mechanism of the conductive shell to the insulating housing is disposed at the opening end edge, the fixing mechanism does not project inside the insulating housing, so that the reduction of the height of the whole electric connector and reduction of the pitch of signal lines are made possible.

Such a configuration can be adopted that the engaging projection in the present invention at this time is formed at the opening end edge forming the opening for fitting of the insulating housing and the engaging hole is formed at the opening end edge of the conductive shell.

In the present invention, such a configuration is adopted that a conductive shell of the mating connector comes into contact with an outer surface of the opening end edge of the conductive shell of the electric connector when the mating connector is fitted to the electric connector, where it is desirable to adopt such a configuration that the conductive shells of both the connectors are configured to stack with each other in a direction orthogonal to the fitting direction. Similarly, in the present invention, it is desirable to adopt such a configuration that both the opening end edges of the insulating housing and the conductive shell fixed in the direction orthogonal to the fitting direction are sandwiched between the conductive shell and the insulating housing of the mating connector.

According to the electric connector having such a configuration, since the insulating housing and the conductive shell of the electric connector are pressed in the direction orthogonal to the fitting direction by the conductive shell of the mating connector, deformations of the insulating housing and the conductive shell at a fitting time can be prevented excellently and improvement of shielding performance to a transmission signal is achieved by the stacked conductive shell.

Further, the present invention is configured such that a front end projection of a mating connector is inserted into the electric connector through the opening for fitting formed in the insulating housing, and it can be suitably applied to such a configuration that the front end projection of the mating connector comes into pressure-contact with a contact point of a conductive contact disposed in the insulating housing in a direction orthogonal to the fitting direction, which results in displacement of the conductive contact, so that both the opening end edges of the insulating housing and the conductive shell are forced to expand in a pressing manner due to the displacement of the conductive contact. For example, mounting of the conductive contact at this time can be performed through a cantilever structure provided with the contact point at a free end of the conductive contact.

According to the electric connector having such a configuration, even if the electric connector is provided with a configuration that the conductive contact displaces in a direction orthogonal to the fitting direction at a fitting time of the mating connector, deformations of the insulating housing and the conductive shell due to the displacement of the conductive contact can be excellently prevented.

EFFECT OF THE INVENTION

As described above, since the electric connector according to the present invention has a configuration that an engaging projection projecting in a fitting direction is provided on one of the opening end edges of the insulating housing and the conductive shell and an engaging hole through which the engaging projection is inserted in the fitting direction is provided on the other opening end edges of the insulating housing and the conductive shell, so that the insulating housing and the conductive shell are fixed to each other in a direction orthogonal to the fitting direction to improve the rigidity of the electric connector the in the same direction largely by such simple work as inserting the engaging projection into the engaging hole, and height reduction and pitch reduction can be achieved by arranging the fixing mechanism between the insulating housing and the conductive shell not to protrude into the insulating housing, where deformation at a fitting time with a mating connector is prevented by a simple configuration so that electrical connection reliability can be improved, thinning and size reduction can be excellently achieved, and an electric connector which has been reduced in size and cost and has high reliability can be obtained.

BEST MODE FOR CARRYING OUT THE INVENTION

Explanation of an embodiment where the present invention is applied to an electric connector which connects a plurality of coaxial cables to a printed wiring board will be made below in detail with reference to the drawings.

[Connector Assembly]

Figure 1:
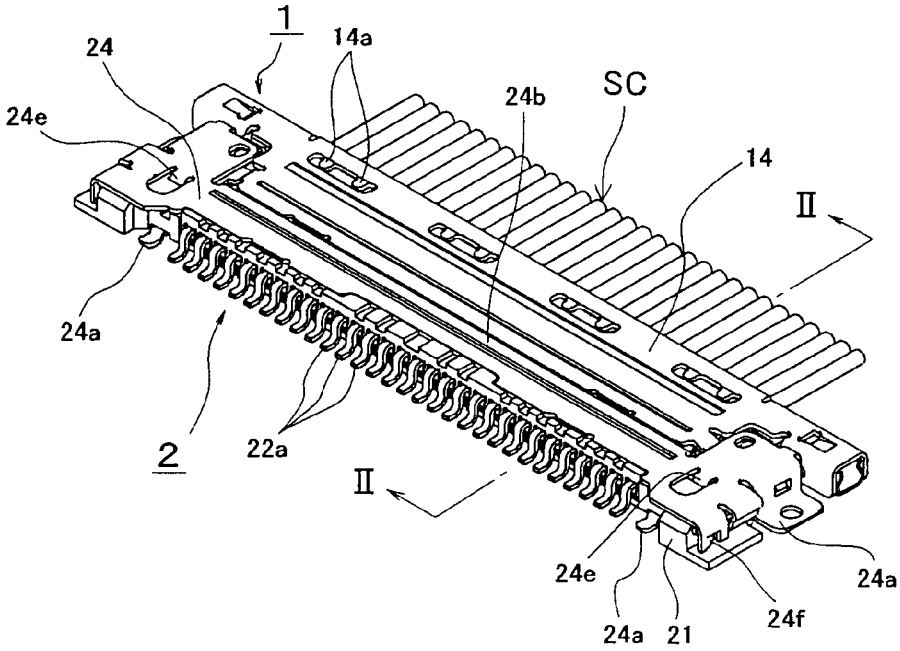
FIG. 1 is an appearance perspective explanatory view of a connector assembly obtained by fitting a mating plug connector to a receptacle connector according to an embodiment of the present invention.
Figure 2:
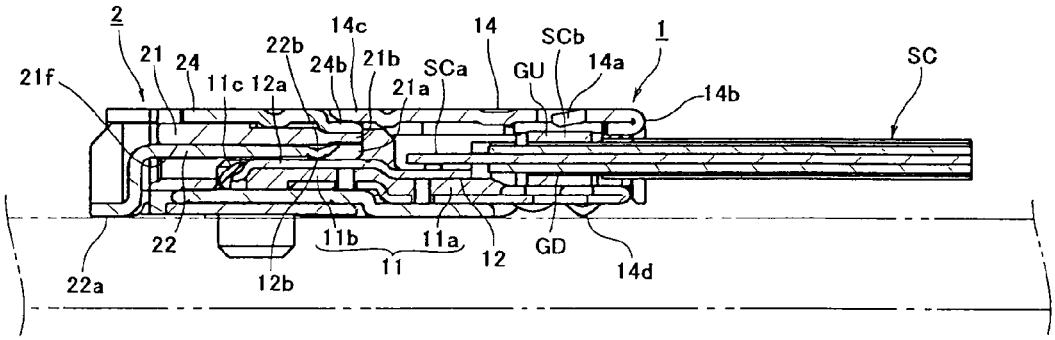
FIG. 2 is a cross-sectional explanatory view of the connector assembly taken along line II-II in FIG. 1.
Figure 3:
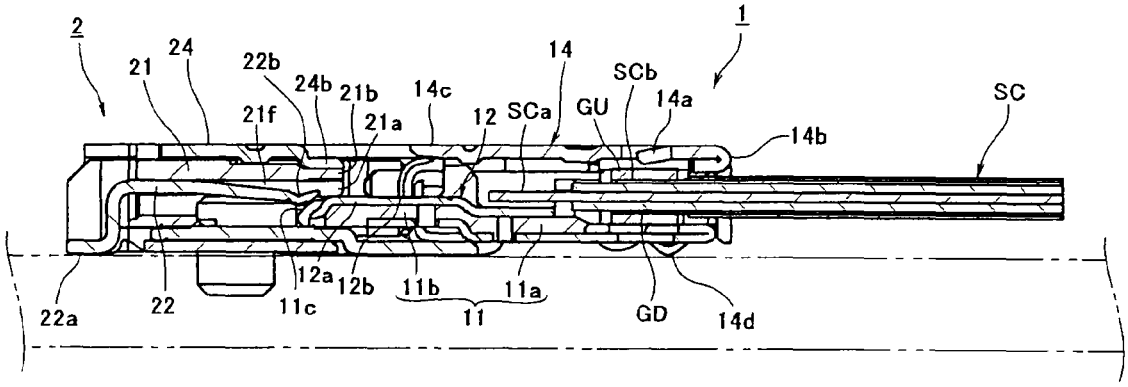
FIG. 3 is a cross-sectional explanatory view corresponding to FIG. 2, representing a state where the connector assembly shown in FIG. 1 is in a course of a fitting work.

First of all, an assembly of an electric connector according to an embodiment of the present invention shown in FIG. 1 and FIG. 2 configures a horizontally fitting type connector assembly comprising a plug connector 1 coupled with terminals of coaxial cables SC and a receptacle connector 2 mounted on a printed wiring board (not shown). That is, in a state that the plug connector 1 serving as a "mating connector" in the present invention is disposed opposite to the receptacle connector 2 in an approximately horizontal direction, the plug connector 1 is moved along a surface of the printed wiring board (see a double-dotted line in FIG. 2) to come close to the receptacle connector 2, and a fitting projection provided at a front end of the plug connector 1 are plugged into an opening for fitting provided in the receptacle connector 2 as shown in FIG. 3, so that fitting of both the connectors 1 and 2 is achieved.

In the embodiment, thus, a plugging direction of the plug connector 1 and a drawing-out direction thereof opposed to the plugging direction approximately correspond to an extending direction of the surface of the printed wiring board, but hereinafter the extending direction of the surface of the printed wiring board is defined as a horizontal direction, while a direction orthogonal to the extending direction is defined as a vertical direction. In the plug connector 1, an inserting direction of the plug connector 1 into the mating receptacle connector 2 is defined as a forward direction, while a drawing direction of the plug connector 1 out of the mating receptacle connector 2, which is opposed to the inserting direction is defined as a backward direction. In the mating receptacle connector 2, a drawing-out direction of the plug connector 1 from the receptacle connector 2 is defined as a forward direction, while a direction opposed to the drawing-out direction is defined as a backward direction.

Figure 4:
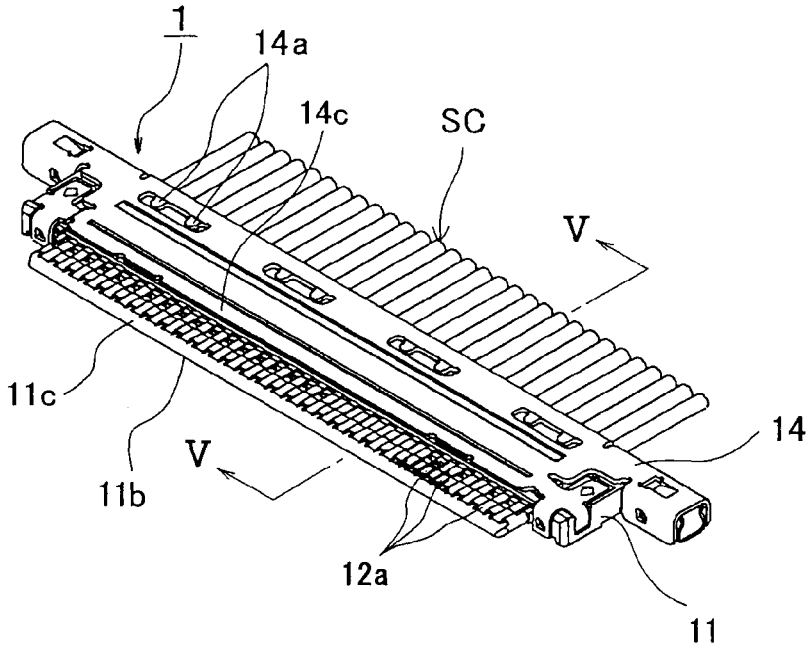
FIG. 4 is an appearance perspective explanatory view showing a plug connector in the connector assembly shown in FIG. 1 alone.
Figure 5:
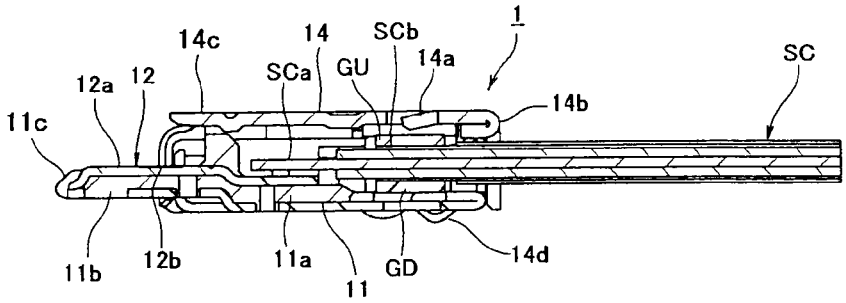
FIG. 5 is a cross-sectional explanatory view of the plug connector taken along line V-V in FIG. 4.

As also shown in FIG. 4 and FIG. 5, here, terminals of a plurality of coaxial cables SC arranged parallel in a multipolar manner are coupled to an end edge on the rear side (hereinafter, called "rear end edge) of the plug connector 1. Since a cable central conductor (signal line) SCa and a cable outer conductor (shield line) SCb are coaxially exposed by removing a covering material from the terminal of the coaxial cable SC, a signal circuit is configured by connecting the cable central conductor SCa disposed along a central axis line of the coaxial cable SC to a conductive contact (conductive terminal) 12 for signal transmission of the plug connector 1 described later.

The cable outer conductor SCb disposed around the outer periphery of the cable central conductor SCa is disposed between an upper ground bar GU and a lower ground bar GD configuring a ground member so that the cable outer conductor SCb is held up and down in a sandwiching manner, and a ground circuit is configured by performing connection by soldering, swaging, pressure welding or the like. These upper ground bar GU and lower ground bar GD are formed from long and thin strip-like members extending in a ruler-like shape along a direction of multipolar arrangement, and are collectively connected by using an elongated solder material or the like in a state that the upper ground bar GU and the lower ground bar GD are mounted along upper and lower faces of the cable outer conductor (shield line) SCb in a multipolar arrangement of the coaxial cable SC. Both the ground bars GU and GD are configured to be connected to the ground via a conductive shell described later or the like.

[Insulating Housing]

On the other hand, both the plug connector 1 and the receptacle connector 2 are provided with insulating housing 11 and 21 formed from long and thin insulating members, respectively. These insulating housings 11 and 21 are formed into hollow casings extending in a long and thin shape along a longitudinal direction which is a multipolar parallel direction of the coaxial cable SC. A long and thin plate-shaped fitting projection 11*b* extending in a longitudinal direction is provided, as described later, at a front end of the insulating housing 11 on the side of the plug connector 1 which is a mating connector.

That is, the insulating housing 11 provided on the side of the plug connector 1 is integrally provided with a main body supporting unit 11*a* disposed on the inner side of the plug connector 1 and a fitting projection 11*b* extending frontward and outward from the main body supporting unit 11*a*. A rear side portion of the conductive contact 12 described later and a portion configuring connection with the coaxial cable SC described above are disposed on an upper surface of the main body supporting unit 11*a* of the insulating housing 11.

The fitting projection 11*b* provided in a projecting manner on the front side of the insulating housing 11 is formed from a thin flat-plate-like member configuring the front end of the insulating housing 11, and is a portion to be firstly inserted to the receptacle connector 2 when both the connectors 1 and 2 are fitted to each other. A distal end guide surface 11*c* for achieving facilitation of fitting of both the connectors 1 and 2 is provided at the front end of the fitting projection 11*b*. The distal end guide surface 11*c* comprises an approximately flat inclined face which comes into contact with the conductive contact 22 of the receptacle connector 2 serving as a mating connector at a time of fitting both the connectors 1 and 2 to each other.

Figure 6:
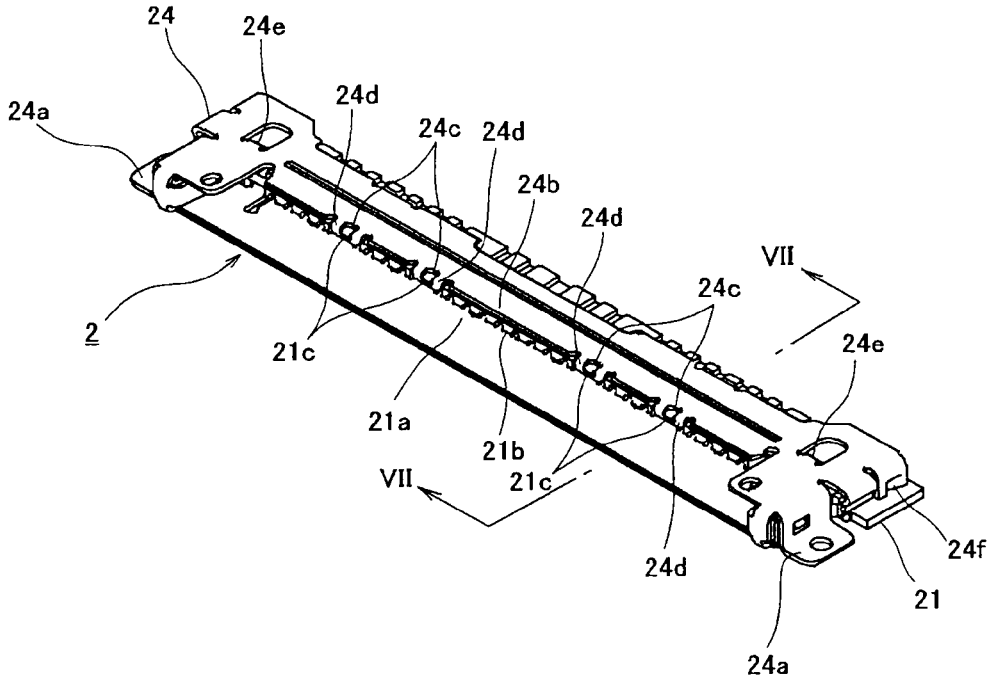
FIG. 6 is an appearance perspective explanatory view showing the receptacle connector in the connector assembly shown in FIG. 1 alone.
Figure 7:
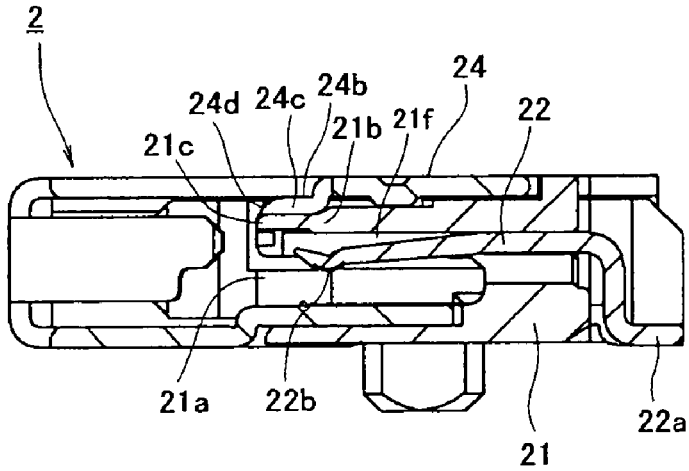
FIG. 7 is a cross-sectional explanatory view of the receptacle connector taken along line VII-VII in FIG. 6.

On the other hand, as also shown in FIGS. 6 and 7, an opening for fitting 21*a* comprising a long and thin space extending in a longitudinal direction is formed at the front end of the insulating housing 21 on the side of the receptacle connector 2. An upper edge of the opening for fitting 21*a* is partitioned in an approximately-horizontal direction by an opening end edge 21*b* formed on the end face on the front end side of the insulating housing 21, and when fitting of both the connectors 1 and 2 is performed, the fitting projection 11*b* on the side of the plug connector 1 is approximately-horizontally inserted toward the inside of the opening for fitting 21*a* on the side of the receptacle connector 2.

[Conductive Contact]

In the insulating housings 11 and 21, a number of conductive contacts (conductive terminals) 12 and 22 are arranged in a multipolar manner at proper pitch intervals along the longitudinal direction (in a direction vertical to the paper plane of FIG. 2). Though the respective conductive contacts 12 and 22 shown in FIG. 2 are configured for signal transmission, they can be configured for ground connection. In plural members of the respective conductive contacts 12 and 22, adjacent ones in the multipolar arrangement direction described above are formed into approximately the same shape from approximately the same material, and are disposed, for example, by being buried by insert molding or pressed to the insulating housings 11 and 21.

That is, the conductive contacts 12 provided on the side of the plug connector 1 are disposed while extending approximately horizontally along an upper surface of the insulating housing 11, and rear-side extending portions of the conductive contacts 12 extending behind step portions provided at midway in the extending direction are disposed on the upper surface side of the main body supporting unit 11*a* of the insulating housing 11. The cable central conductors (signal lines) SCa of the coaxial cable SC are joined by soldering to the rear-side extending portions of the conductive contacts 12 in a state of being abutted thereto by being placed from above. Soldering connection between the plural members of the cable central conductors SCa and the conductive contacts 12 are collectively performed.

On the other hand, terminal electrode units 12*a* configuring front-side extending portions extending in front of the step portions of the conductive contacts 12 are disposed on the upper surface of the fitting projection 11*b* provided to configure a front end of the insulating housing 11. The terminal electrode units 12*a* are disposed in a multipolar manner at proper pitches on the upper surface of the fitting projection 11*b* of the insulating housing 11.

Contact point recessed portions 12*b* brought in electric contact with the receptacle connector 2 are provided at the front-side extending portions of the conductive contacts 12. Further, distal ends heading from the terminal electrode units 12*a* of the conductive contacts 12 toward the distal end side (leftward in FIG. 5) extend to form steps. This distal end step portion has a shape downwardly bent by one step and then extending toward the distal end, and is configured to be buried on the inner side of the distal end of the fitting projection 11*b* provided to the insulating housing 11.

On the other hand, solder connecting units 22*a* having an approximately reversed-L shape in side view are provided at the rear ends (left end portions in FIG. 2) of the conductive contacts (conductive terminals 22) attached to the insulating housing 21 of the receptacle connector 2. The solder connecting units 22*a* are collectively joined by soldering after being placed on signal conducting paths or a ground conducting paths on the printed wiring board (see the double-dotted line in FIGS. 2 and 3) in actual use.

Furthermore, the conductive contacts (conductive terminals) 22 extend forward from the solder connecting units 22*a* on the rear side in a cantilever manner. More specifically, the conductive contacts 22 are raised approximately vertically upward from the solder connecting units 22*a* on the rear side, and extend from the raised upper ends to frontward (rightward in FIG. 2) in a cantilever manner. Contact point projecting portions 22*b* downwardly projecting into a V shape are provided at the front-side distal ends of the conductive contacts 22. The contact point projecting portions 22*b* provided to the conductive contacts 22 are provided to configure abutting receiving units to the plug connector 1, and lower-end-side top portions of the contact point projecting portions 22*b* are configured to be resiliently brought into contact with the contact point recessed portions 12*b* provided to the conductive contacts 12 on the side of the plug connector 1 when the plug connector 1 is fitted to the receptacle connector 2 as described above. Through such a contact relationship, electric connection between both the contact points 12*b* and 22*b* is performed.

[Conductive Shell]

On the other hand, both upper and lower surfaces of outer surfaces of the respective insulating housings 11 and 21 of the plug connector 1 and the receptacle connector 2 are covered with conductive shells 14 and 24 made from thin-plate-like metal members respectively. These conductive shells 14 and 24 are made by forming the thin-plate-like metal members into proper shapes, and provide shielding performance with respect to a transmission signal to each connector and attached to configure a part of the ground circuit. The conductive shells 14 and 24 configuring the ground circuit are portions in which electric connection is firstly performed when both the connectors 1 and 2 are fitted to each other.

Though the conductive shell 14 provided on the side of the plug connector 1 serving as a mating connector is attached to the insulating housing 11 to cover the insulating housing 11 from both above and below after both the ground bars (ground members) GU and GD is joined to the coaxial cable SC by soldering, a lower-half-side portion of the conductive shell 14 in the present embodiment is integrally molded with the insulating housing 11 by insert molding. A plurality of ground connection tongue pieces 14*a* is formed, by notching on an upper face side of the conductive shell 14, along the connector longitudinal direction which is the multipolar arrangement direction. These ground connection tongue pieces 14*a* are formed by notching into a cantilevered plate spring and extend obliquely downward, and are joined by soldering or brought in resilient contact with the upper face of the upper ground bar GU.

A pressing projection 14*b* is formed to be bent inward at a rear end edge (right end portion in FIG. 5) on the upper face side of the conductive shell 14, and when attachment of the conductive shell 14 is performed in the above-described manner, the pressing projection 14*b* is brought in pressing contact with an insulating covering of the coaxial cable SC from above.

Further, a pressing pressure plate 14*c* formed into an eave shape is provided at a front end edge (left end portion in FIG. 5) on the upper face side of the conductive shell 14. The pressing pressure plate 14*c* is configured to project approximately horizontally by a proper length frontward (leftward in FIG. 5) from the opening end edge on the front end side of the insulating housing 11, so that the pressing pressure plate 14*c* of the conductive shell 14 is brought into contact with the outer surface of the opening for fitting of the receptacle connector 2, as described later.

On the other hand, in the conductive shell 24 provided to the receptacle connector 2, holding-down portions 24*a* bent and formed to project outward are provided on both ends and both front and rear ends in the longitudinal direction of the connector. These holding-down portions 24*a* are joined by soldering to the ground conductive paths (not shown) formed on the printed wiring board (not shown), thereby electric connection of the ground circuit is performed, as well as the whole receptacle connector 2 is firmly fixed.

A front end edge (a left end portion in FIG. 7) on an upper face of the conductive shell 24 is disposed to extend along an outer surface of the opening end edge 21*b* forming the opening for fitting 21*a* of the insulating housing 21. That is, the opening end edge 24*b* provided to partition an upper edge of the opening for fitting 21*a*, which is the same as in the insulating housing 21 in an approximately-horizontal direction, is provided at a front-end side of the conductive shell 24, and the opening end edge 24*b* on the side of the conductive shell 24 is disposed to cover the opening end edge 21*b* on the side of the insulating housing 21 from outward. Both the opening end edges 21*b* and 24*b* are disposed at approximately the same position as in front-back direction (horizontal direction) which is a fitting direction of both the connectors 1 and 2.

Figure 8:
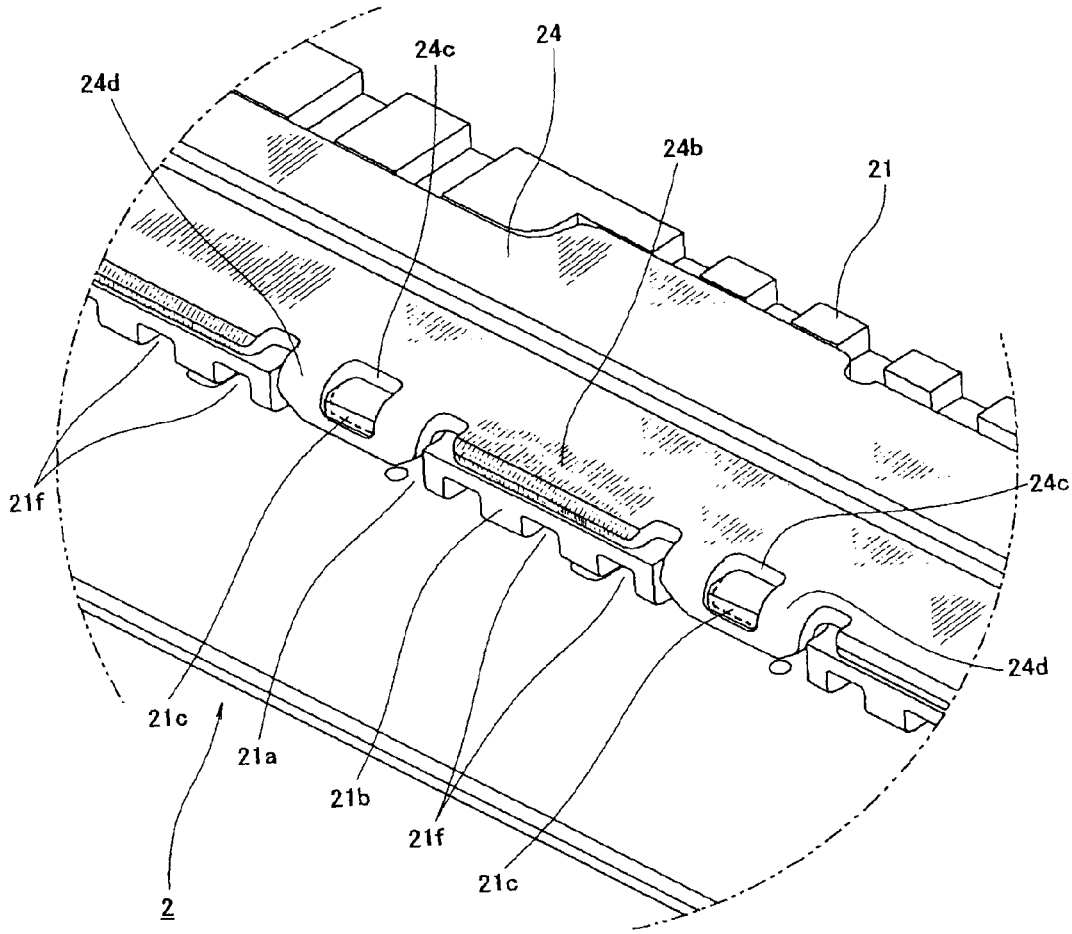
FIG. 8 is an appearance perspective explanatory view showing an opening end edge on a front end side of the receptacle connector shown in FIG. 1 to FIG. 7 which is a main portion of the present invention.

An engaging projections 21*c* projecting forward (leftward in FIG. 7) in the fitting direction (horizontal direction) with the plug connector 1 serving as a mating connector is provided at the opening end edge 21*b* on the side of the insulating housing 21, as shown in FIG. 8. Further, an engaging hole 24*c* into which the engaging projection 21*c* on the side of the insulating housing 21 is inserted in the fitting direction (horizontal direction) is provided at the opening end edge 24*b* on the side of the conductive shell 24. Fixation mechanisms in which the engaging projection 21*c* on the side of the insulating housing 21 and the engaging hole 24*c* on the side of the conductive shell 24 act as a pair are disposed at plural points at proper intervals in the longitudinal direction of the receptacle connector 2.

To explain more detailed shapes thereof, the engaging projection 21*c* provided on the side of the insulating housing 21 is formed into a shape of a flat-plate-like projecting small piece, and the engaging hole 24*c* provided on the side of the conductive shell 24 is formed to penetrate horizontally through a curved seat unit 24*d* formed by bending the opening end edge 24*b* of the conductive shell 24 approximately orthogonally downward. When the conductive shell 24 is attached to the insulating housing 21, the engaging projection 21*c* is inserted into the engaging hole 24*c*.

Here, though the conductive contacts 22 of the receptacle connector 2 are attached along accommodating mounting grooves 21*f* provided in a recess manner to an inner wall face (upper wall face in FIG. 7) of the insulating housing 21, each of the engaging projections 21*c* is disposed at a position above the accommodating mounting groove 21*f*. In such a positional relationship, even if the conductive contacts 22 are arranged at narrow pitches for example, the engaging projections 21*c* can be disposed at arbitrary positions without being influenced by such arrangement. Though the curved seat unit 24*d* provided with the engaging hole 24*c* is formed into such a shape extending while downwardly curving at its front end as described above, a lower end edge formed by the extension of the curved seat unit 24*d* is shortened in order not to hang down into an inner region of the opening for fitting 21*a*. Therefore, when the opening for fitting 21*a* is shortened in a height direction (vertical direction) to achieve height reduction of the whole connector, an influence of the curved seat unit 24*d* can be eliminated.

Further, in a state that the engaging projections 21*c* are inserted into the engaging holes 24*c* in the above-described manner, the engaging projections 21*c* and the engaging holes 24*c* have a relationship of abutting on each other in the vertical direction orthogonal to the fitting direction of both the connectors 1 and 2, so that an excellent fixation force in the same direction (vertical direction) can be obtained. Then, such a fixation function caused by the fixation mechanism comprising the engaging projections 21*c* and the engaging holes 24*c* maintains the insulating housing 21 and the conductive shell in an excellent fixed state in the vertical direction orthogonal to the fitting direction of both the connectors 1 and 2.

Here, the opening end edge 24*b* of the conductive shell 24 is formed into a bending step shape downwardly extending while forming a step, so that the pressing pressure plate 14*c* provided at the front end edge (the left end portion in FIG. 5) of the conductive shell 14 on the plug connector 1 serving as a mating connector is brought into contact from above with the step-like downward portion of the conductive shell 24. That is, in the state that both the connectors 1 and 2 are fitted to each other, an arrangement relationship is obtained in which an inner surface of the conductive shell 14 on the side of the plug connector 1 is in contact with an outer surface of the conductive shell 24 on the side of the receptacle connector 2, and in such a fitting state, the conductive shells 14 and 24 of both the connectors 1 and 2 are disposed to overlap with each other in the vertical direction orthogonal to the fitting direction.

Further, as described above, in the state that the conductive shells 14 and 24 of both the connectors 1 and 2 have overlapped with each other in the vertical direction orthogonal to the fitting direction, the insulating housing 21 and the conductive shell 24 fixed to each other as described above are sandwiched between the pressing pressure plate 14*c* provided to the conductive shell 14 on the side of the plug connector 1 and the fitting projection 11*b* provided to the insulating housing 11 on the side of the plug connector 1 via the conductive contacts 22 on the side of the receptacle connector 2.

That is, when the fitting projection 11*b* of the plug connector 1 serving as a mating connector is inserted into the insulating housing 21 of the receptacle connector 2, the fitting projection 11*b* on the side of the plug connector 1 is upwardly brought in pressure contact with the conductive contacts 22 on the side of the receptacle connector 2, as described above, thereby the conductive contacts 22 are displaced upward in a lifting manner. Then, according to the upward displacement of the conductive contacts 22, both the opening end edges 21*b* and 24*b* of the insulating housing 21 and the conductive shell 24 are forced to upwardly expand in a pressing manner especially at the central portion in the longitudinal direction. In the present embodiment, however, such a configuration is adopted that the insulating housing 21 and the conductive shell 24 on the side of the receptacle connector 2 are sandwiched between the fitting projection 11*b* and the pressing pressure plate 14*c* of the conductive shell 14 on the side of the plug connector 1. In particular, since the insulating housing 21 and conductive shell 24 on the side of the receptacle connector 2 are pressed downwardly by the pressing pressure plate 14*c* on the side of the plug connector 1, upward expansion or bulge of both the opening end edges 21*b* and 24*b* in the insulating housing 21 and the conductive shell 24 on the side of the receptacle connector 2 is excellently prevented.

Figure 9:
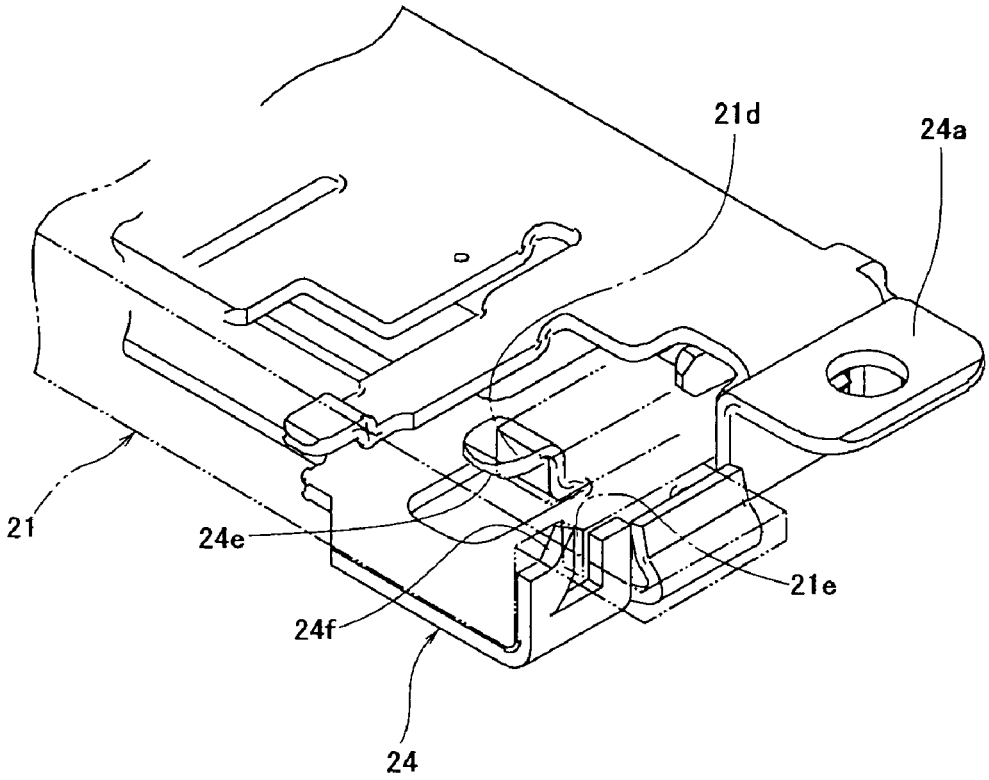
FIG. 9 is an illustrative appearance perspective explanatory view of an insulating housing and a conductive shell of the receptacle connector represented in FIG. 1 to FIG. 7, which shows a mounting relationship between the insulating housing and the conductive shell at both ends of the receptacle connector in a vertically reversed manner and is viewed from a bottom face side.

On the other hand, the conductive shell 24 and the insulating housing 21 of the receptacle connector 2 according to the present embodiment obtain a fixation force in the front-back direction (horizontal direction), which is the fitting direction of both the connectors 1 and 2, especially by a fixation mechanism as shown in FIG. 9. That is, as shown in FIG. 9, a pair of fitting hook units 24*e* and 24*f* for fixing the insulating housing 21 in the front-back direction (horizontal direction) is provided at each of the both ends of the conductive shell 24 in the longitudinal direction thereof. The pair of fitting hook units 24*e* and 24*f* provided in the conductive shell 24 is configured to be fitted to both fitting engagement units 21*d* and 21*e* provided on the side of the insulating housing 21 in an abutting manner in the front-back direction, so that the conductive shell 24 and the insulating housing 21 of the receptacle connector 2 are engaged with each other in the fitting direction of both the connectors 1 and 2.

Further, at this time, the plug connector 1 serving as a mating connector is configured to be fitted along the surface of the printed wiring board (see double-dotted line shown in FIGS. 2 and 3) on which the receptacle connector 2 is mounted, and rear supporting units 14*d* brought in slidable contact with the surface of the printed wiring board are provided at several places at a rear end on the bottom side of the conductive shell 14 mounted on the plug connector 1. The rear supporting units 14*d* have a function of lifting up the rear end of the plug connector 1 by an amount corresponding to the height of the rear supporting units 14*d*.

That is, when the lower face of the fitting projection 11*b* of the plug connector 1 is brought into contact with an inner bottom face of the conductive shell 14 facing the lower faces of the contact point projecting portions 22*b* of the conductive contacts 22 of the receptacle connector 2 as described above, the rear supporting units 14*d* are brought in slidable contact with the surface of the printed wiring board, thereby the whole plug connector 1 is maintained approximately horizontally to the surface of the printed wiring board. Four rear supporting units 14*d* according to the present embodiment are disposed in total, two for each of both the ends and the central portion, and can be formed by hollowing the metal plate forming the conductive shell 14 from the upper side to the lower side into a shape projecting from bottom faces of the conductive shell 14, so-called "dimple shape".

According to the embodiment with such a configuration, only by performing the simple work that the engaging projections 21*c* provided on the side of the insulating housing 21 are inserted into the engaging holes 24*c* provided on the side of the conductive shell 24 of the receptacle connector 2, the insulating housing 21 and the conductive shell 24 are fixed to each other in the vertical direction orthogonal to the fitting direction of both the connectors 1 and 2, so that vertical rigidity at the opening for fitting of the receptacle connector 2 is largely increased, therefore deformation of the insulating housing 21 and the conductive shell 24 of the receptacle connector 2 at the fitting time of both the connectors 1 and 2 is excellently prevented.

Further, since the engaging projections 21*c* and the engaging holes 24*c*, which configure a fixation mechanism for the insulating housing 21 and the conductive shell 24, are disposed at the opening end edges 21*b* and 24*b*, respectively, and they do not project into the insulating housing 21, it is possible to reduce the whole height of the electric connector and to make a pitch of signal lines narrow.

Furthermore, according to the above-described embodiment, since the insulating housing 21 and the conductive shell 24 of the receptacle connector 2 are kept pressed in a downward direction orthogonal to the fitting direction by the pressing pressure plate 14*c* provided to the conductive shell 14 of the plug connector 1 serving as a mating connector, deformation of the receptacle connector 2 at the fitting time is more excellently prevented. Besides, since the front ends of the conductive shells 14 and 24 of both the connectors 1 and 2 are disposed in a vertically-stacking manner at this time, improvement of shield performance with respect to transmission signals is achieved by the conductive shells 14 and 24.

Here, in the present embodiment, especially, according to the upward displacement of the conductive contacts 22 of the receptacle connector 2 at the fitting time of both the connectors 1 and 2, the insulating housing 21 and the conductive shell 24 tend to be expanded and deformed in an upward direction orthogonal to the fitting direction, however, according to the configuration of the present embodiment, the insulating housing 21 and the conductive shell 24 of the receptacle connector 2 are downwardly kept pressed by the pressing pressure plate 14*c* provided to the conductive shell 14 of the plug connector 1 as described above. Therefore, against the upward displacement of the conductive contact 21, the deformation at the fitting time of both the connector 1 and 2 is excellently prevented.

Though the invention made by the present inventors has been specifically described based on the embodiment, the present invention is not limited to the above-described embodiment, and it is obvious that the present invention can be variously modified without departing from the gist of the invention.

For example, in the above-described embodiment, through the engaging projections 21*c* are provided at the opening end edge 21*b* on the side of the insulating housing 21, as well as the engaging holes 24*c* are provided at the opening end edge 24*b* on the side of the conductive shell 24, it is possible to provide engaging projections and engaging holes in the opposite members.

Further, though the above-described embodiment is applied to a horizontally-fitting type electric connector, the present embodiment can be similarly applied to a vertically-fitting type electric connector.

Furthermore, the present invention is not limited to a connector for coaxial cables such as the above-described embodiment, and is similarly applicable to a connector for insulating cables, an electric connector of the type of including plural coaxial cables and insulating cables in a mixing manner, an electric connector to which a flexible wiring board or the like is joined, a board-to-board connector which connects printed boards to each other, and the like.

Additionally, in the above-described embodiment, the engaging projections 21*c* are partially provided at the opening end edge 21*b* on the side of the insulating housing 21, as well as the engaging holes 24*c* are partially provided at the opening end edge 24*b* on the side of the conductive shell 24, but the engaging projections 21*c* and the engaging holes 24*c* are provided across the respective opening end edges 21*b* and 24*b*.

INDUSTRIAL APPLICABILITY

As described above, the present invention can be applied widely to various electric connectors used in various electric equipments.

DESCRIPTION OF REFERENCE NUMERALS

1: plug connector
11: insulating housing
11*a*: main body supporting unit
11*b*: fitting projection
11*c*: distal end guide surface
12: conductive contact (conductive terminal)
12*a*: terminal electrode unit
12*b*: contact point recessed portion
14: conductive shell
14*a*: ground connection tongue piece
14*b*: pressing projection
14*c*: pressing pressure plate
14*d*: rear supporting unit
2: receptacle connector
21: insulating housing
21*a*: opening for fitting
21*b*: opening end edge
21*c*: engagement projection
21*d*, 21*e*: fitting engagement unit
21*f*: accommodating mounting groove
22: conductive contact (conductive terminal)
22*a*: solder connecting unit
22*b*: contact point projecting portion
24: conductive shell
24*a*: hold-down
24*b*: opening end edge
24*c*: engaging hole
24*d*: curved seat unit
24*e*, 24*f*: fitting hook unit
SC: coaxial cable
SCa: cable center conductor (signal wire)
SCb: cable external conductor (shielding wire)
GU: upper ground bar
GD: lower ground bar

The invention claimed is:

1. An electric connector which is configured such that a mating connector is appropriately inserted in a fitting direction through an inside of an opening for fitting formed in an insulating housing of the electric connector, comprising:

an opening end edge of a conductive shell covering the insulating housing from outside thereof is disposed to extend along an outer surface of an opening end edge forming the opening for fitting of the insulating housing, wherein, an engaging projection projecting along a fitting direction used with the mating connector is provided at one of the opening end edges of the insulating housing and the conductive shell, an engaging hole, into which the engaging projection is inserted in the fitting direction, is provided on the other of the opening end edges of the insulating housing and the conductive shell, and the engaging projection is inserted into the engaging hole without projection from the outer surface of the conductive shell so that the insulating housing and the conductive shell are fixed to each other in a direction orthogonal to the fitting direction used with the mating connector, whereby both the opening end edges are disposed at approximately the same position as in a fitting direction of both the connectors.

2. The electric connector according to claim 1, wherein, the engaging projection is formed at the opening end edge forming the opening for fitting of the insulating housing, and the engaging hole is formed at the opening end edge of the conductive shell.

3. The electric connector according to claim 1, wherein, the electric connector is configured such that a conductive shell of the mating connector is able to come into contact with an outer surface of the opening end edge of the conductive shell when the mating connector is fitted, and the conductive shells of both the connectors become disposed in a stacking manner in the direction orthogonal to the fitting direction.

4. The electric connector according to claim 3, wherein, the electric connector is configured such that both the opening end edges of the insulating housing and the conductive shell fixed to each other in the direction orthogonal to the fitting direction become sandwiched between the conductive shell and the insulating housing of the mating connector.

5. The electric connector according to claim 4, wherein, the electric connector is configured such that a front end projection of the mating connector is inserted into the inside of the electric connector through the opening for fitting formed in the insulating housing, and the front end projection of the mating connector comes into pressure-contact with a contact point of a conductive contact disposed in the insulating housing in the direction orthogonal to the fitting direction, which results in displacement of the conductive contact, so that both the opening end edges of the insulating housing and the conductive shell are forced to expand in a pressing manner according to the displacement of the conductive contact.

6. The electric connector according to claim 5, wherein, the electric connector is configured such that the conductive contact is mounted in a cantilever manner having the contact point at a free end of the conductive contact.

* * * * *